US006804940B2

(12) United States Patent
Resta

(10) Patent No.: US 6,804,940 B2
(45) Date of Patent: Oct. 19, 2004

(54) APPARATUS FOR INSERTING TUFT ASSEMBLIES IN A MATTRESS

(75) Inventor: Roberto Resta, Faenza (IT)

(73) Assignee: Resta S.r.l., Faenza (IT)

( * ) Notice: Subject to any disclaimer, the term of this patent is extended or adjusted under 35 U.S.C. 154(b) by 0 days.

(21) Appl. No.: 10/637,729

(22) Filed: Aug. 11, 2003

(65) Prior Publication Data

US 2004/0040134 A1 Mar. 4, 2004

(30) Foreign Application Priority Data

Aug. 29, 2002 (IT) ..... BO2002A0549

(51) Int. Cl.[7] ..... B65B 63/00; D05B 11/00
(52) U.S. Cl. ..... 53/521; 53/524; 112/2.2
(58) Field of Search ..... 53/521, 524; 112/2.2

(56) References Cited

FOREIGN PATENT DOCUMENTS

EP 0 844 210 5/1998

EP 1 253 107 10/2002

*Primary Examiner*—Eugene Kim
*Assistant Examiner*—Gloria R. Weeks
(74) *Attorney, Agent, or Firm*—Guido Modiano; Albert Josif; Daniel O'Byrne

(57) ABSTRACT

An apparatus for inserting tuft assemblies through a mattress, with retention disks, comprising a mattress locking structure composed of: two walls, flat and parallel with a space for accommodating the mattress for compression; a first carriage, supported by one of the walls with a first disk feeder and a tuft insertion device; a second carriage, supported by the second wall supporting a second disk feeder; an actuator for the carriages; each one of the feeders for disks comprises a disk magazine that is supported on a respective carriage and contains disks arranged in stack acted upon by a pusher in order to keep a front disk of the stack in a pick-up position; and pick-up elements each with a transfer element, supported by a carriage.

12 Claims, 10 Drawing Sheets

APPARATUS FOR INSERTING TUFT ASSEMBLIES IN A MATTRESS

BACKGROUND OF THE INVENTION

The present invention relates to an apparatus for inserting tuft assemblies in a mattress.

As is known, in order to prevent excessive bulging due to the pressure of the internal springs against the filling layers, mattresses are kept flat by a plurality of retention elements, known as tuft assemblies, one of which is shown for the sake of clarity in FIG. 1 of the accompanying drawings.

In said FIG. 1, the tuft assembly is designated by the reference letter P and comprises a tension element T, which consists of a tape that has two bars S1 and S2 at its opposite ends. Tuft assemblies of this kind are known for example from British patents no. 903,464 and 1,541,077.

The tuft assemblies are inserted through the mattress by way of suitable manually actuated needles such as those disclosed for example in the cited British patents or by way of automatic apparatuses such as those disclosed in U.S. Pat. No. 6,032,345 and U.S. Ser. No. 10/126,535 by the same Applicant.

In these devices, the needle performs a forward stroke by means of which it draws the tension element and one bar through the mattress. When, at the end of the forward stroke, the bar exits from the opposite side of the mattress with respect to the one where the needle entered, it is released by the needle so that the two bars rest on the opposite faces of the mattress.

To prevent the mattress for tearing or being damaged by the friction thereon of the bars during use, protective elements are interposed between such bars and the surface of the mattress and are constituted by substantially circular disks made of felt or other suitable material, often known by the English term "tuft".

In the apparatuses according to U.S. Pat. No. 6,032,345, EPA-1,167,279 and U.S. Ser. No. 10/126,535, the disks are distributed by devices that are designed so as to align the individual disks with the needle when the needle crosses the mattress. However, these devices have some substantial flaws. First of all, they have a limited capacity and must be reloaded frequently with disks. Secondly, they cannot ensure the alignment of the disks with the needle during the insertion of the tuft assemblies through the mattress. The needle, in passing through the mattress, in fact is often subjected to deviations from the penetration line that make it engage the disks off-center.

SUMMARY OF THE INVENTION

The aim of the present invention is therefore to provide an apparatus that does not suffer the drawbacks noted above.

Within this aim, an object of the present invention is to provide an apparatus that has a high production capacity and is reliable in operation.

This aim and this and other objects are achieved with an apparatus for inserting, through a mattress, tuft assemblies constituted by a flexible tension element that has, at its opposite ends, two bars that are arranged in a T-shaped configuration or other similar retention elements and are adapted to abut, with the interposition of a first disk and of a second disk or of another similar protective element, against the opposite faces of the mattress, said apparatus comprising a structure for locking said mattress that is composed of: two walls, which are flat and mutually parallel and delimit a space for accommodating a mattress that is compressed to a thickness that is shallower than the length of the tuft assemblies; a first carriage, which is supported by one of said walls and supports a first disk feeder and a device for inserting tuft assemblies through said mattress; a second carriage, which is supported by the second one of said walls and supports a second disk feeder; means for actuating said carriages along a preset path; said insertion device comprising: a tuft assembly loader; a needle that is guided at right angles to said mattress and has a tip that is provided with a seat that is suitable to receive a first bar of a tuft assembly that is fed by said loader; and means for actuating said needle through said mattress between a position in which said tip is upstream of the mattress, in order to receive said first bar in said seat, and a position in which said tip is downstream of the mattress, in order to release said bar from said seat; first means, mounted on said first carriage, for picking up a disk from said first feeder and placing it upstream of said mattress and in alignment with said needle; and second means, mounted on said second carriage, for picking up a disk from said second feeder and placing it downstream of said mattress and in alignment with said needle; characterized in that each one of said disk feeders comprises a disk magazine that is supported on a respective carriage and is suitable to contain disks arranged so as to form a stack that is perpendicular to said mattress and pusher means that act on said stack in order to keep the front disk of said stack in a pick-up position, and in that each one of said pick-up and placement means comprises a transfer element, which is supported by said carriage and is actuated so as to pick up said front disk from said magazine and transfer it in alignment with said needle.

BRIEF DESCRIPTION OF THE DRAWINGS

Further features of the invention will become better apparent from the detailed description that follows of a preferred embodiment thereof, illustrated only by way of non-limitative example in the accompanying drawings, wherein.

DESCRIPTION OF THE PREFERRED EMBODIMENTS

The invention is illustrated with reference to an apparatus as disclosed in U.S. Ser. No. 10/126,535, of which a brief description is given hereafter for the sake of brevity, reference being made to the cited application for fuller comprehension.

Figure 2:
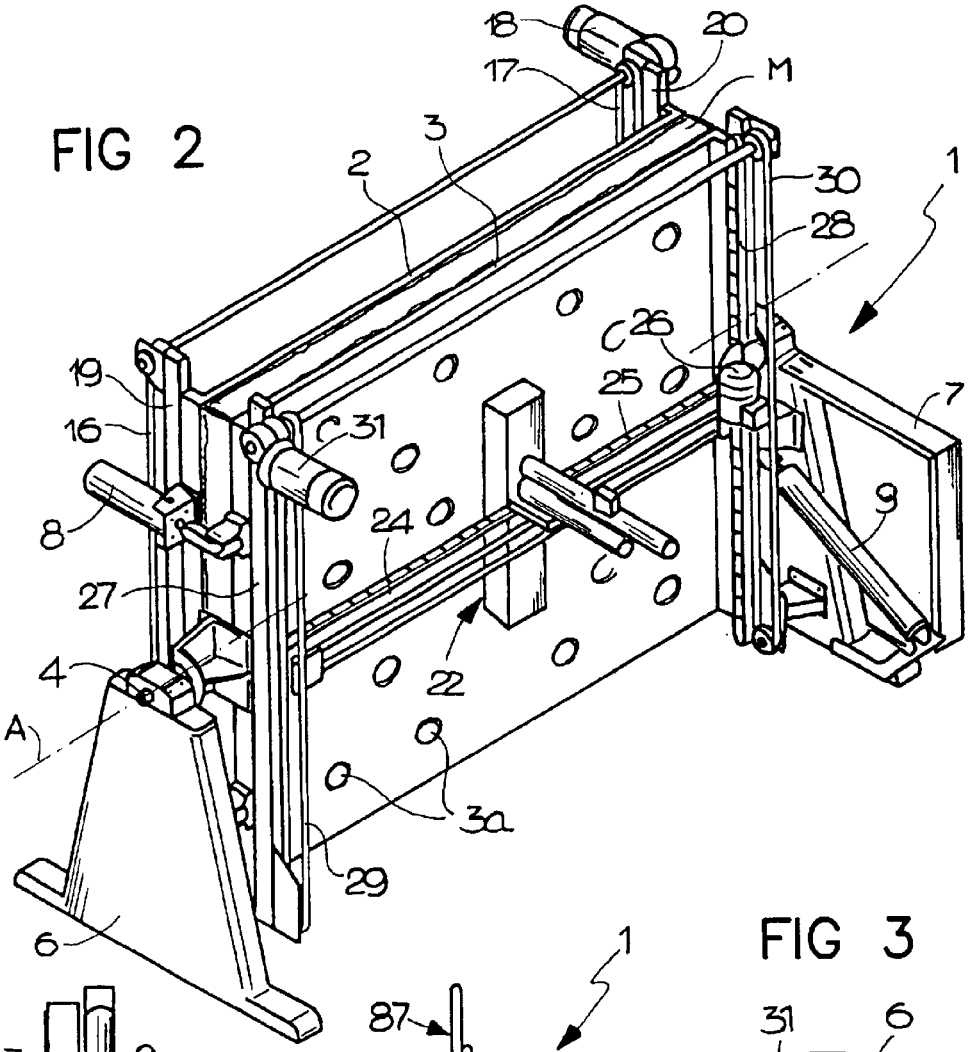
FIG. 2 is a perspective view of the apparatus.

As shown in FIG. 2, the apparatus is generally designated by the reference numeral 1 and comprises a structure that is composed of two rectangular walls 2 and 3 that delimit a space for accommodating a mattress M.

The wall 2, by virtue of pivots 4 and 5, can rotate about an axis A on sides 6 and 7, while the wall 3 can be moved toward and away from the wall 2 through actuation of four jacks 8 (only one of which is shown in the figures and the others being similar), arranged so that there are two jacks on each side. The jacks 8 allow to block a mattress M that is accommodated in the space between the walls 2 and 3 and to compress it to a thickness that is shallower than the length of the tuft assemblies P to be inserted. The insertion of the mattress in the space between the walls occurs when the walls are horizontal. Once insertion has occurred and the mattress has been locked, the walls 2 and 3 are rotated into the vertical position by a jack 9 and then the tuft assemblies are applied.

Figure 1:
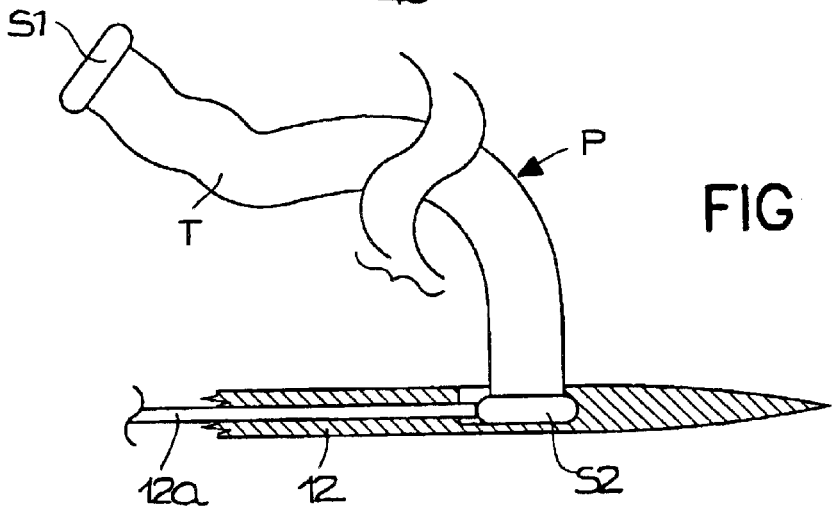
FIG. 1 is a view of a tuft assembly and of part of the needle for its insertion.
Figure 3:
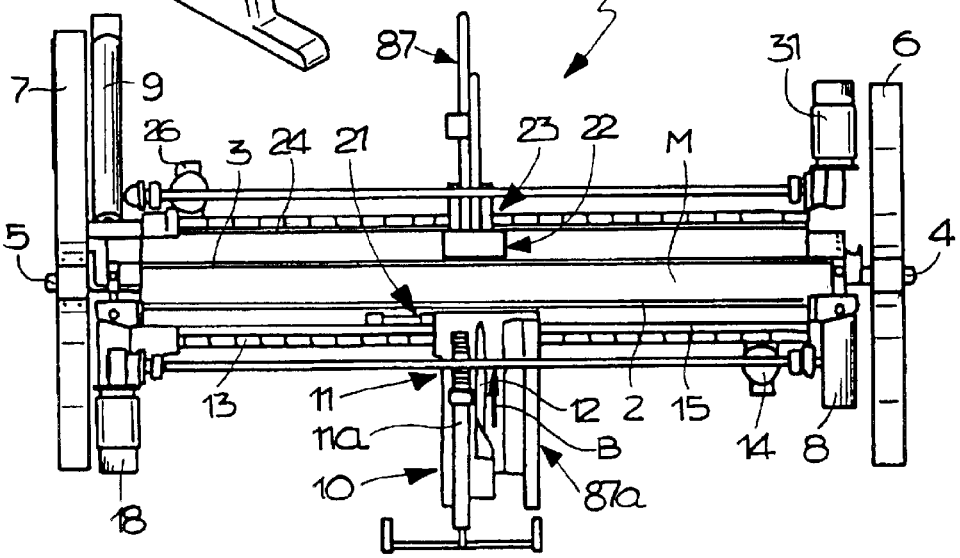
FIG. 3 is a plan view of the apparatus of FIG. 1.

To insert the tuft assemblies P through the mattress M, there is an insertion device, generally designated by the reference numeral 10 (FIG. 3), of the type disclosed in U.S. Ser. No. 10/126,535. Said device is installed on a carriage 11, and comprises a tuft assembly loader 11*a* and a needle 12, which is pushed at right angles through the mattress M by a pneumatic cylinder. The needle 12 (see also FIG. 1) has a tip provided with a receptacle that is suitable to receive and retain, by means of a movable rod 12*a*, a bar S2 of the tuft assembly P to be inserted.

When the tip has passed through the mattress, the rod 12*a* retracts, allowing to expel the bar S2 from the receptacle before the needle begins the return stroke. In this manner, the two bars S1 and S2 are arranged on opposite sides of the mattress (see FIG. 15), so that when the mattress is released by moving mutually apart the walls 2 and 3, said bars rest on the opposite faces of said mattress. Obviously, the walls 2 and 3, in order to allow the passage of the needle 12, have openings 2*a*, 3*a* (see also FIGS. 13–16) that are arranged variously depending on where the tuft assemblies are to be applied.

To allow the placement of the needle 12 at the points where the tuft assemblies are to be applied to the mattress, the carriage 11 can move horizontally on a beam 15 by being actuated by a belt drive 13 (FIG. 3), which is actuated by a reversible gearmotor 14; said beam, in turn, under actuation of a further drive composed of two belts 16 and 17 (FIG. 2) driven by a gearmotor 18, can move parallel to itself along vertical metallic guides 19 and 20, thus allowing the needle to arrange itself in any point of the mattress M that is aligned with the openings 2*a* and 3*a*.

To prevent the regions of the mattress on which the bars S1 and S2 rest from being damaged due to friction or to prevent the bars from causing discomfort to the person lying on the mattress, two protective disks D1, D2 made of felt or other suitable material are interposed between the mattress and the bars S1 and S2, which can embed themselves therein so that they are no longer felt by the user.

The disks D1 and D2 are arranged between the bars and the mattress by means of two front and rear units 21 and 22, which, taking as reference the direction B of penetration of the needle 12, are arranged upstream (front unit) and downstream (rear unit) of the mattress, respectively. In particular, the front unit 21 is installed on the carriage 11, while the rear unit 22 is installed on a carriage 23 that can move on the opposite side of the mattress M on a horizontal beam 24. The location of the units 21 and 22 on the respective carriages 11 and 23 is fully intuitive and is shown schematically only by way of example in FIGS. 2 and 3. The carriage 23 and the beam 24 are moved respectively horizontally and vertically by means of a transmission system that is fully identical to the one that drives the carriage 11 and the beam 15 and is synchronized with it so that the disks D1 and D2, which must be positioned by the units 21 and 22 upstream and downstream of the mattress M, respectively, are always aligned with the needle 12. In particular, the carriage 23 can move along the beam 24 by means of a transmission belt that is driven by a reversible gearmotor 26, while the beam 24 can move along the vertical guides 27 and 28 by means of the belts 29 and 30, which are actuated by the reversible gearmotor 31.

The unit 22 for positioning the disks D2 downstream of the mattress M is now described with reference to FIGS. 4 to 9. Said unit comprises a housing 32 (FIG. 4), which has a U-shaped cross-section and forms a vertically elongated compartment in which the active elements of the unit are accommodated. The housing 32 is fixed to the carriage 23 so that one of its walls is contiguous to the wall 3 of the apparatus. Inside the housing 32, a rectangular plate 36 is fixed to the side walls 34 and 35 thereof and is spaced from the wall 33; an extension 37 is coupled to said plate in an upward region.

Figure 6:
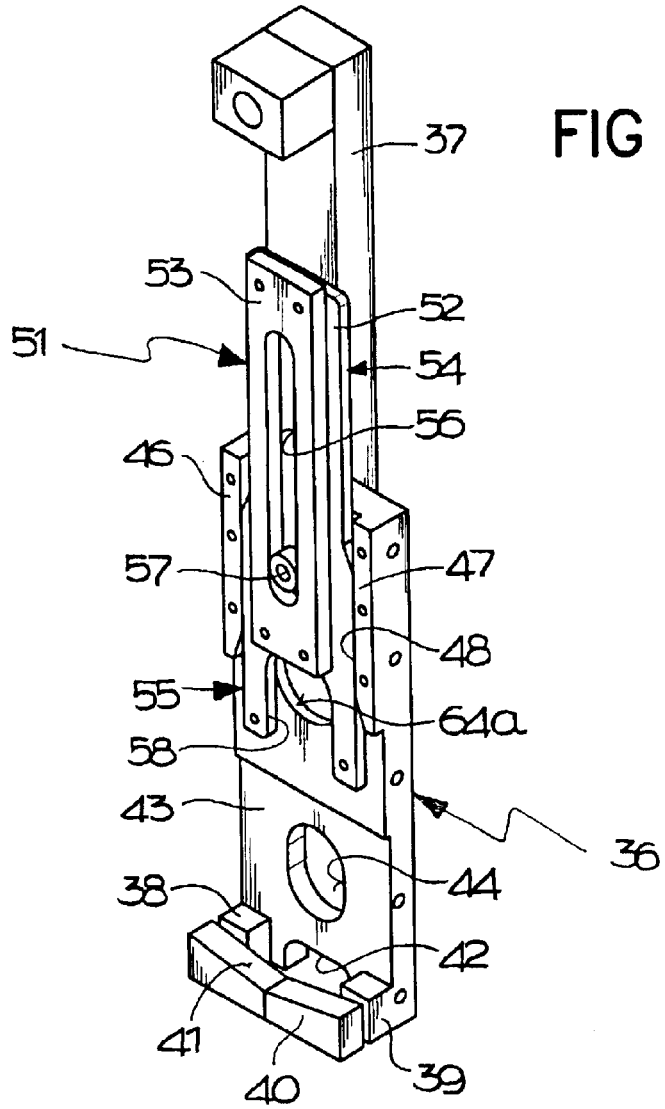
FIG. 6 is a partial perspective view of the disk pick-up and placement means of the disks of FIGS. 4 and 5.

As shown more clearly by FIG. 6, in the lower corners of the plate 36 there are two blocks 38 and 39, which protrude toward the wall 33 of the housing 32 and to which a bridge 40 is fixed. The bridge 40 has an upper side 41 that forms a groove that is shaped like a very wide V.

In the lower region of the plate 36, in front of the bridge 40, there is a recess 42, and above said recess, at the center of the lower region 43 of the plate 36, there is a rounded opening 44 opposite which there is a circular opening 45 (FIG. 9) of the wall 33 of the housing 32. Two side walls 46 and 47 protrude from the sides of the part of the plate 36 that lies above the region 43, and a vertical channel 48 is formed between them. Two strips 49 and 50 (FIG. 7) are fixed on the edges of the side walls and partially close the channel 48, forming two undercuts and a sliding guide for a sliding block. 51 that is part of a transfer element detailed hereinafter.

The sliding block 51 is composed of two superimposed rectangular plates 52 and 53 (FIG. 6). The plate 53 is narrower than the plate 52, so as to leave free the lateral margins, which by remaining engaged under the strips 49 and 50 allow the guided sliding of the sliding block 51 in the channel 48.

In turn, the plate 52 comprises an upper portion 54 that is narrower than the lower portion 55. In this manner, when the lower portion 55 has descended until it exits from the channel 48, the sliding block 51 can perform transverse movements with respect to the vertical sliding direction.

Figure 17:
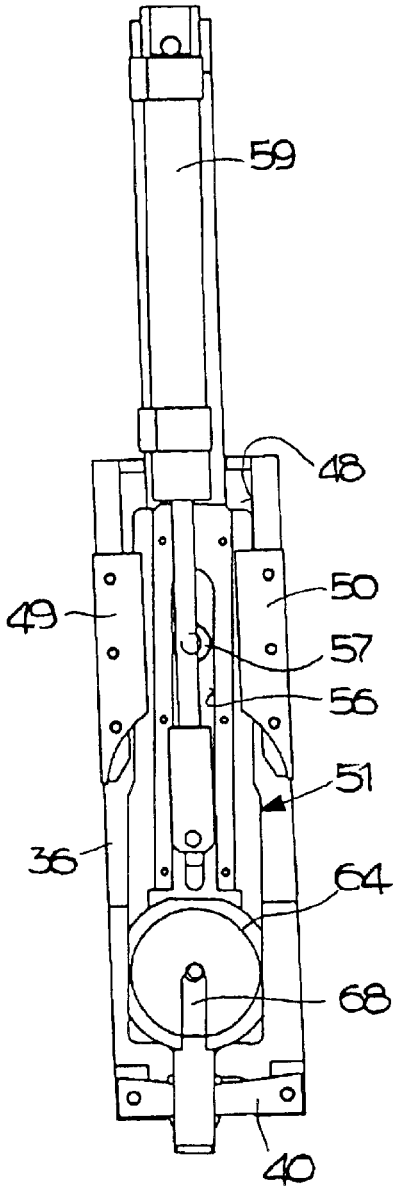
FIGS. 17 and 18 are opposite views of the disk pick-up and placement means in an operating condition.

A longitudinally elongated slot 56 is formed in the sliding block 51, and a roller 57, fitted on the plate 36 so as to cantilever out, slidingly engages in said slot. The length of the slot 56 and the position of the roller 57 are chosen so that when the lower portion 55 of the sliding block 51 has exited from the channel 48, so that only the upper portion 54 is inserted in said channel, the sliding block 51, due to the reduced width of said upper portion, can perform oscillations about the pivot 57 and arrange itself obliquely with respect to the channel 48, as shown in FIG. 17.

The lower portion 55 of the plate 52 is shaped like a fork (see FIGS. 6 and 7), in which the prongs are substantially as thick as the disks D2 and form a seat 58.

The sliding block 51 is actuated with a reciprocating motion by means of a hydraulic actuator 59 (FIG. 5), particularly a pneumatic one, whose cylinder is articulated to the top of the extension 37. The stem of the actuator 59 supports, at its end, a bracket 60 that is crossed by a pin 61 that engages in a slot 62 of an L-shaped element 63 to which a substantially rounded body 64 is monolithically coupled. The body 64 is fixed to the prongs of the lower portion 55 of the sliding block 51 and has milled regions for receiving the prongs, which close the seat 58 in a downward region so as to form a circular seat that is shaped complementarily to the disks D2. Through of the actuator 59, the body 64 transfers individual disks D2, picked up in a raised position from a suitable feeder, described hereafter, through an opening 64*a* (FIG. 7) of the plate 36, to a lowered position, in which each picked disk is arranged in front of the opening 44 in order to be crossed by the needle 12 for the insertion of the tuft assembly P.

The body 64 has, on the side directed toward the mattress M, a conical concavity 65 (FIGS. 5 and 9), which converges toward a through duct 66 that is aligned with the center of the seat 58.

The body 64, which due to the concavity 65 guides the needle 12 in the duct 66 during the insertion of the tuft assembly P, is provided in a downward region with a radial slot 67 in which a sector 68 is suitable to engage, said sector 68 being complementary to the slot 67 in terms of thickness and shape, so as to complement the surface of the concavity 65 and form a sort of funnel that acts as a guide for the needle 12.

The sector 68 is rigidly coupled to a block 69, which has a notch 70 that allows its oscillating support on the bridge 40. The block 69 is retained on the bridge 40 by a plate 71 that is fixed to the lower end of the block 69.

In the notch 70, above the bridge 40, there is a metallic tab 72 that acts as a support for a spring 73 (FIG. 9), which is partially accommodated in a dead hole 74 that lies within the sector 78. The opposite ends of the metallic tab 72 protrude from the notch 70 and have lateral expansions that keep the tab coupled to the block 69. In this manner, the tab 72, when relative movements occur between the block 69 and the bridge 40, maintains its position inside the notch 70 and prevents the spring 73 from sliding on the upper side 41 of the bridge 40.

A fork-shaped elastic lamina 75 is fixed by means of screws 74 to the block 69 on the side that is adjacent to the plate 36 and below the seat 58 and has two prongs 76 that extend so as to partially cover the seat 58 and delimit a groove 77 that lies substantially opposite the center of the opening 44 of the plate 36.

A pivot 78 protrudes in a cantilevered fashion from the block 69, under the elastic lamina 75, through the lower recess 42 of the plate 36, and a roller 79 can rotate thereon; said roller lies on the plane of a frame 80 acting as a slider, which is adjacent to the face of the plate 36 that lies opposite the one on which the sliding block 51 slides.

Figure 4:
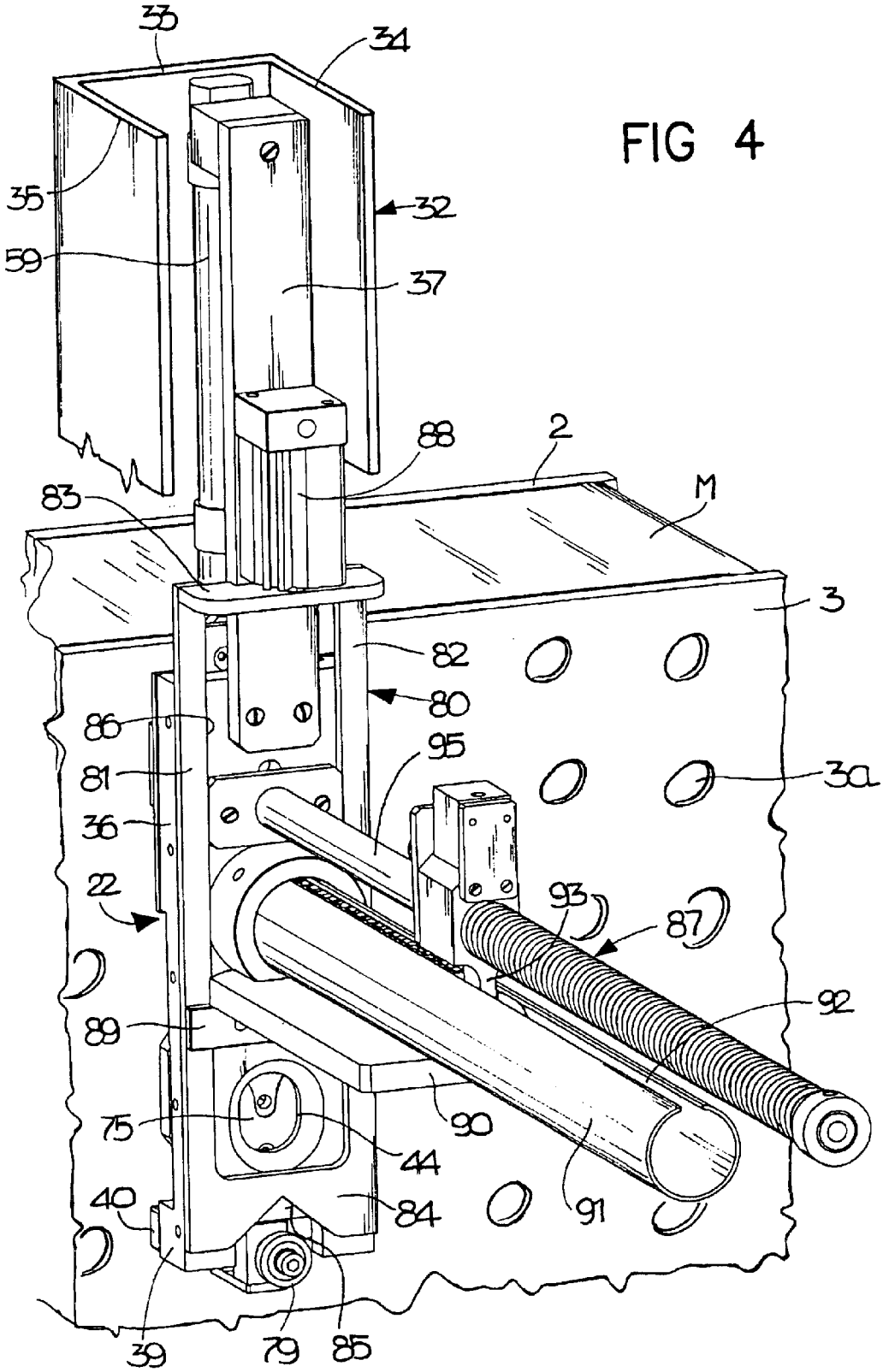
FIG. 4 is a rear perspective view of the disk feeder arranged behind the mattress and of the disk pick-up and placement means.
Figure 5:
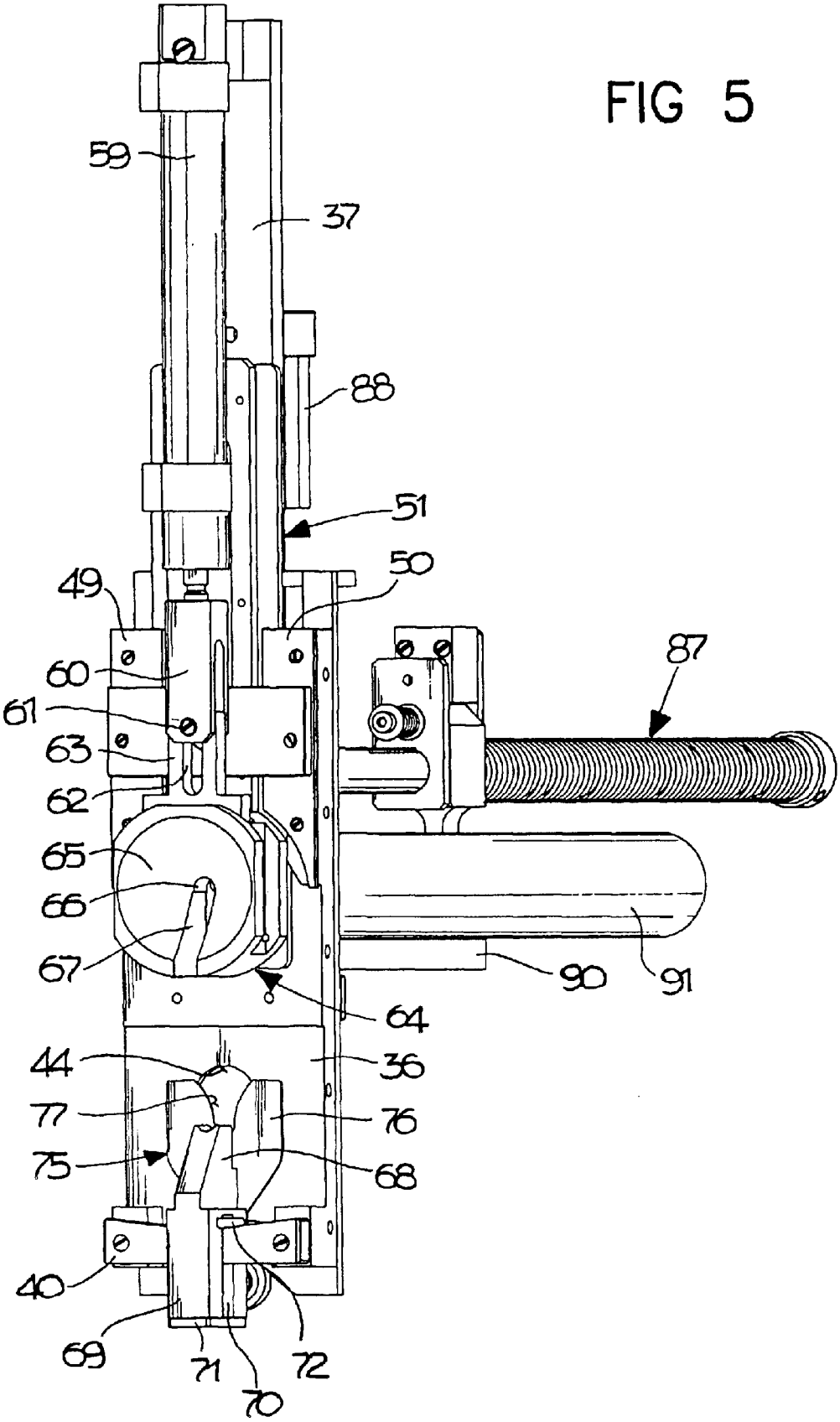
FIG. 5 is a perspective view, taken from the opposite side with respect to FIG. 4, of the disk feeder arranged behind the mattress and of the disk pick-up and placement means.
Figure 7:
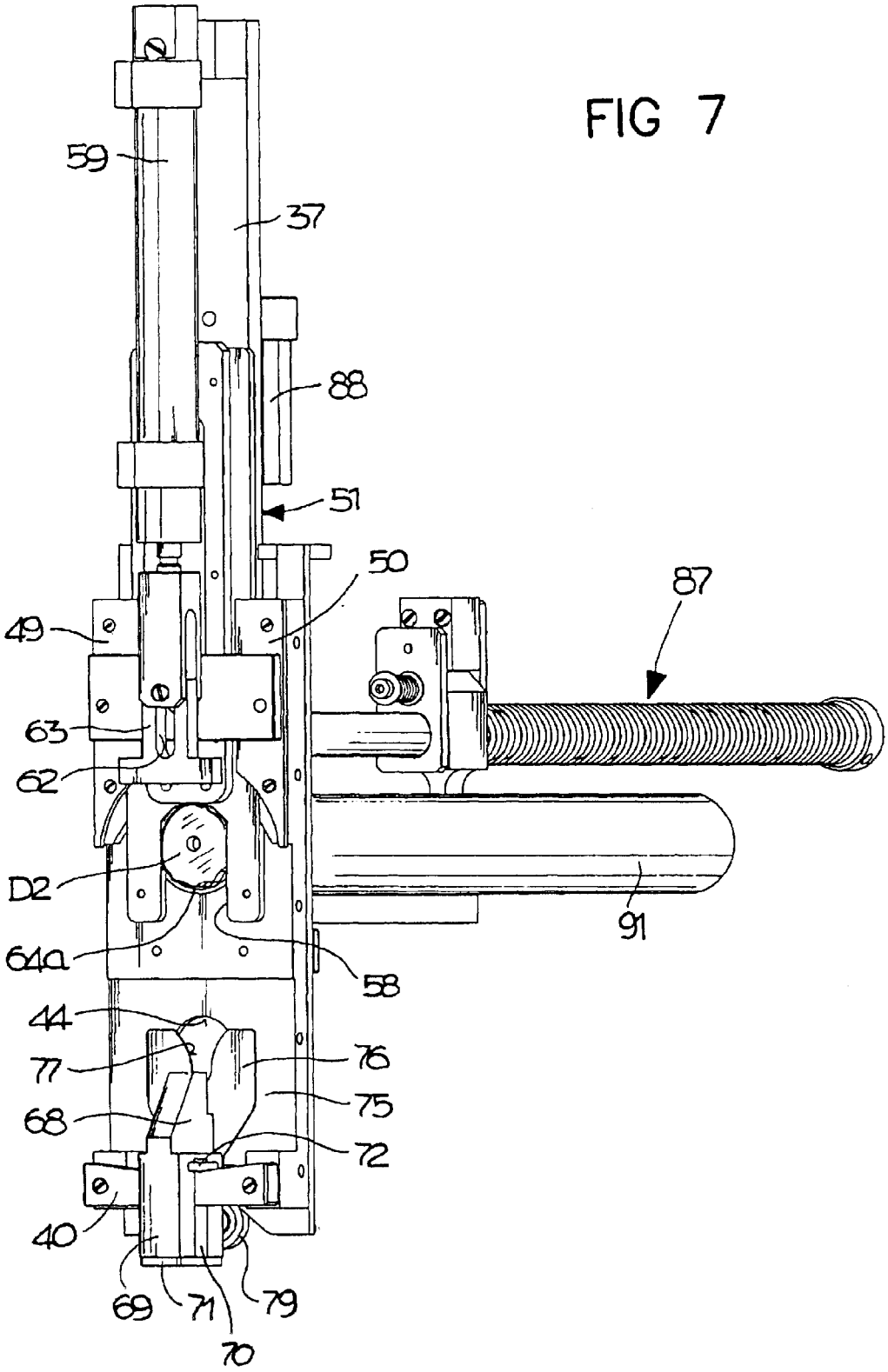
FIG. 7 is a perspective view, similar to FIG. 5, in which some elements have been removed in order to show the hidden parts.
Figure 10:
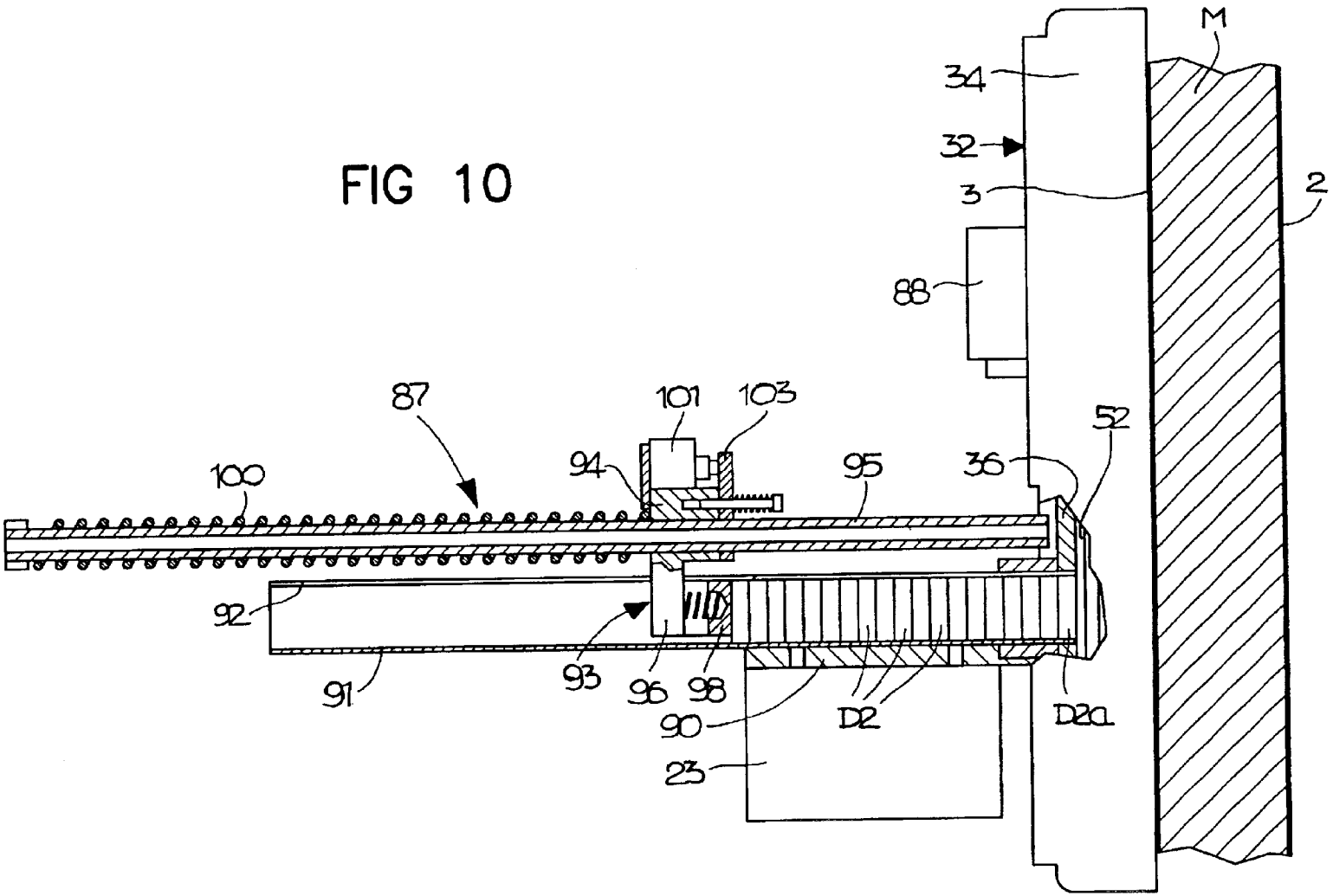
FIG. 10 is a sectional side view, taken along a vertical plane, of the rear disk feeder.

The frame 80 (FIG. 4) is rectangular and comprises two parallel strips 81 and 82 that slide on the vertical lateral edges of the plate 36 and are connected, at their top, by a bracket 83 and, at their lower end, by a cross-member 84 that has a concave cam 85 formed by two V-shaped ramps. The strips 81 and 82, the bracket 83 and the cross-member 84 surround an opening 86 through which the feeder of the disks D2, generally designated by the reference numeral 87 in FIGS. 4 and 10, is fixed to the plate 36.

The frame 80 can be actuated vertically by means of a hydraulic actuator 88, particularly a pneumatic one, in which the cylinder is fixed to the extension 37 and the stem is connected to the bracket 83. In order to keep the frame 80 guided, the strips 81 and 82 slide in seats formed at the opposite ends of a bar 89 (FIG. 4) that is fixed transversely to the plate 36, below a bracket 90 by way of which the unit 22, arranged to the rear of the mattress, is mounted on the carriage 23 (FIGS. 4 and 10).

The feeder 87 (see FIGS. 10, 11 and 12) comprise a disk magazine D2 that is composed of a cylindrical container 91 that is associated with one end at right angles to the plate 36 through the opening 86 and is open at the opposite end in order to allow the loading of a stack of disks D2. The container 91 has a longitudinal slot 92, through which a pusher 93 is made to advance; said pusher pushes the stack of disks through the opening 64*a* (FIGS. 6 and 7) so that the front disk D2*a* is accommodated in the seat 58 when the sliding block 51 is in the raised position.

The pusher 93 is constituted by a slider 94 that can slide on a cylindrical tubular guide bar 95 that is fixed to the plate 36 parallel to the container 91. The slider 94 has an arm 96 that protrudes through the slot 92 into the container. A bush 97 is associated with the arm 96 and is coaxial to the container; a piston 98 is guided therein and is actuated by a spring 99 that is interposed between said piston and the arm 96. The piston 98 is kept in abutment against a shoulder (not shown) by action of the spring 99, in a position that is partially external to the bush 97 so that it can retract into said bush when it is pushed against the stack of disks D2.

In order to perform the advancement of the pusher 93, as the disks D2 are picked up when the tuft assemblies P are inserted, there is a spring 100 that is arranged on the bar 95 and acts on the slider 94. The spring 100 is stronger than the spring 99 and in order to prevent its thrust from causing an excessive compression of the stack of disks, which would otherwise compromise the pick-up of the front disk D2*a* by the sliding block 51 and its transfer in front of the opening 44, there is a retracting element that retracts and blocks the slider 94 so that the thrust on the stack of disks applied by means of the piston 98 by the spring 100 is neutralized and only the thrust of the weaker spring 99 remains effective.

Said retracting element comprises a pneumatic or electromechanical actuator 101 (FIGS. 11 and 12), which is fixed to the slider 94 and is provided with a stem 102 that is parallel to the tubular bar 95. A lever 103 is articulately coupled to the end of the stem 102, and a circular hole 104 is formed therein: the bar 95 passes through said hole with play. A rod 105 is guided through the lever 103, between the coupling point of the stem 102 and the hole 104; said rod is fixed to the slider 94, is parallel to the stem 102, and has a head 106 at one end. A bush 107 can slide on the portion of the rod 105 that is comprised between the head 106 and the lever 103 and has a flange 108 that is kept rested on the lever 103 by means of a spring 109 that abuts against the head 106 with the interposition of a washer 110.

The apparatus is completed by the unit 21 for picking up and placing the front disks D1 and by the feeder for said disks that is associated therewith. However, the unit 21 can be of any kind, since does not have to cope with the problem of the bending of the needle because said needle, when it has to pass through the front disk D1, is still outside the mattress and therefore cannot be subjected to any bending. For the sake of brevity in description, it is assumed hereinafter that the unit 21 is of the type disclosed in U.S. Ser. No. 10/126,535 and that the feeder that supplies it with disks is identical to the one described in relation to FIGS. 10 to 12; said feeder for the front disks D1 is generally designated by the reference numeral 87*a* in FIG. 3 in order to distinguish it from the feeder of the rear disks D2.

Figure 13:
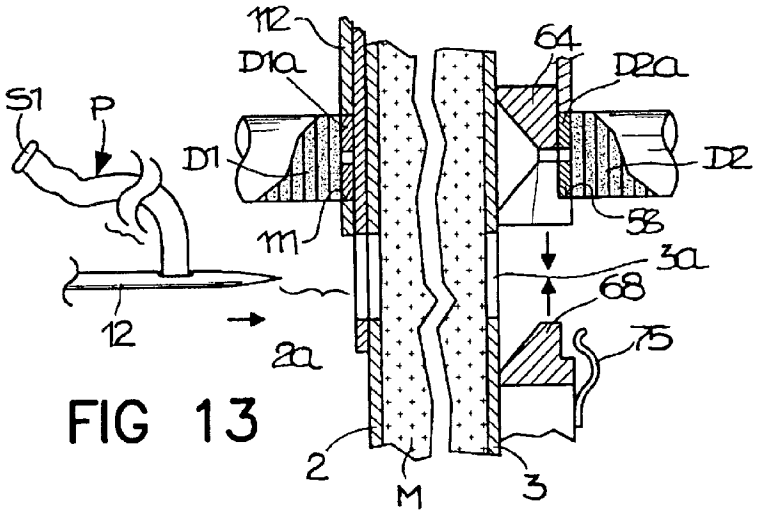

The operation of the apparatus is now described starting from the functional situation shown in FIG. 13, which illustrates schematically the mattress M arranged in a compressed position between the walls 2 and 3 and the leading front disk D1*a* and the leading rear disk D2*a* of the respective stacks, arranged on opposite side of the mattress, prior to their alignment with the needle 12, which must insert the tuft assembly P through said disks and through the mattress. In particular, the leading rear disk D2*a* is accommodated in the seat 58 of the body 64, which in this step faces, through the opening 64*a* of the plate 36, the container 91 of the rear feeder 87. Likewise, the leading front disk D1*a* is accommodated in a similar seat 111 of a transfer element, generally designated by the reference numeral 112, which is supported on the carriage 11 and is actuated with a reciprocating motion between a position for receiving the disk D1*a* from the corresponding feeder and a position for centering the disk D1*a* in front of the needle 12.

Simultaneously with the arrangement of the disk D1*a* in front of the needle, the sliding block 51 is actuated so as to descend by means of the actuator 59, which causes the engagement of the sector 68 in the slot 67 of the body 64. It should be noted that in this step the frame 80 is raised, so that the roller 79 is disengaged from the cam 85 and the sector 68 can descend in contrast with the return action of the spring 73. When the body 64 has reached the lower stroke limit (FIG. 14), the sector 68, assisted by the spring 73, closes the concavity 65 in a conical fashion, while the disk D2*a* is retained in the seat 58 by the elastic lamina 75 and in front of the opening 44 (see FIG. 9).

Figure 15:
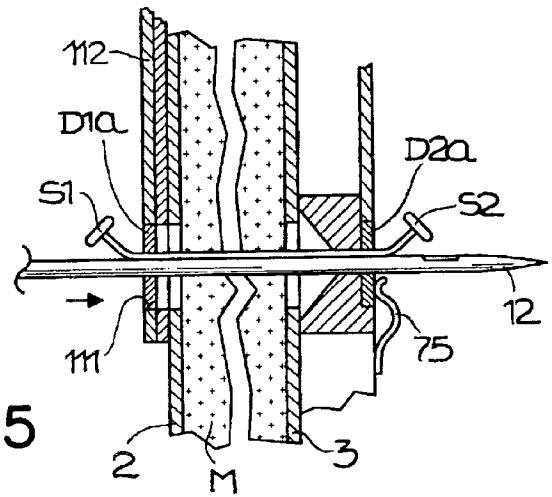

At this point the advancement of the needle 12 is actuated; after passing through the disks D1*a* and D2*a* and the mattress M, said needle releases the bar S2 downstream of the disk D2*a* (FIG. 15). After the needle has been retracted (FIG. 16), the actuator 88 is also activated together with the actuator 59 that raises the body 64 and acts on the roller 79, lowering the sector 68, by means of the cam 85 of the frame 80. In this manner, the disk D2*a*, after leaving the seat 58 and no longer being retained by the elastic lamina 75, is extracted by the tension element T when the unit 22 moves horizontally on the beam 24 or vertically on the guides 19 and 20 in order to be positioned on another tuft assembly application point.

Figure 18:
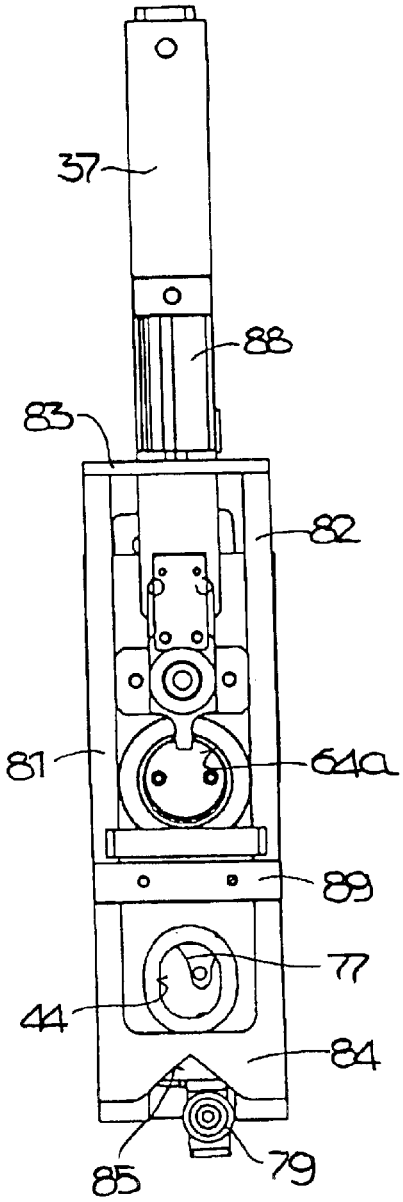

The particularity of the invention resides in the fact that it can ensure the insertion of the needle 12 through the rear disk D2*a* even when the needle, during passage through the mattress, bends because it strikes obstacles inside the mattress, such as for example springs, which would otherwise not allow to center the duct 66 and would damage the needle. In the apparatus. according to the invention, a needle that deviates from its straight path in fact abuts against the conical wall of the concavity 65, so as to produce a force component that is substantially radial with respect to the central duct 66 of the concavity 65. However, according to the invention, said component is used to move the body 64 and therefore the concavity 65 into the position in which the duct 66 is aligned with the tip of the bent needle, taking advantage of the fact that when the body 64 moved the disk D2*a* in front of the opening 44 the portion 55 of the sliding block 51 left the channel 48, so that the portion 54, being narrower, does not allow to keep the sliding 51 guided further. Accordingly, the sliding block 51, under the lateral thrust of the needle, can perform a lateral oscillation about the pivot 57, which allows to return the duct 66 of the concavity 65 into alignment with the tip of the bent needle. This situation is shown in FIGS. 17 and 18, which also show that in this situation the sector 68 follows the oscillation of the body 64, also assuming an inclination and producing friction against the side 41 of the bar 40 with the tab 72 actuated by the spring 73.

After the needle 12 has transferred the bar S2 past the disk D2*a* and has returned to the initial position, leaving the tuft assembly P inserted through the mattress (FIG. 16), the descent of the frame 80 is actuated by means of the actuator 88; said frame acts, by means of the cam 85, on the roller 79 so as to push the sector 68 out of the slot 67. As soon as the sector 68 has exited from the slot 67, the engagement of the roller 79 on the V-shaped cam 85 allows to return the sector 68 to the center of the side 41 of the bar 40, where it remains because it is retained by the pressure applied to the tab 72 by the spring 73.

A similar behavior occurs if the needle is diverted upward or downward. In the first case, the upward movement to which the body 64 is subjected is allowed by the slot 62. In the second case, the sector 68 descends in contrast with the elastic reaction of the spring 73.

It is evident that the invention achieves the proposed aim and object. Advantageously, only the regions of the walls of the slot 67 that form the concavity 65 are parallel to each other. The remaining regions of the walls, which form the duct 66, diverge radially so as to form a guide that facilitates the insertion of the top of the sector 68 during the first portion of the stroke for coupling to the body 64.

A substantial functional advantage of the apparatus is offered by the feeder 87, which allows to optimize the individual picking of the disks by reducing the friction with which they adhere to each other. For this purpose, during the advancement of the stack of disks, the actuator 101 is deactivated, so that the lever 103, by virtue of the spring 109, rests on the slider 94 and the bar 95 can slide freely in the hole 104 of the lever 103.

Figure 8:
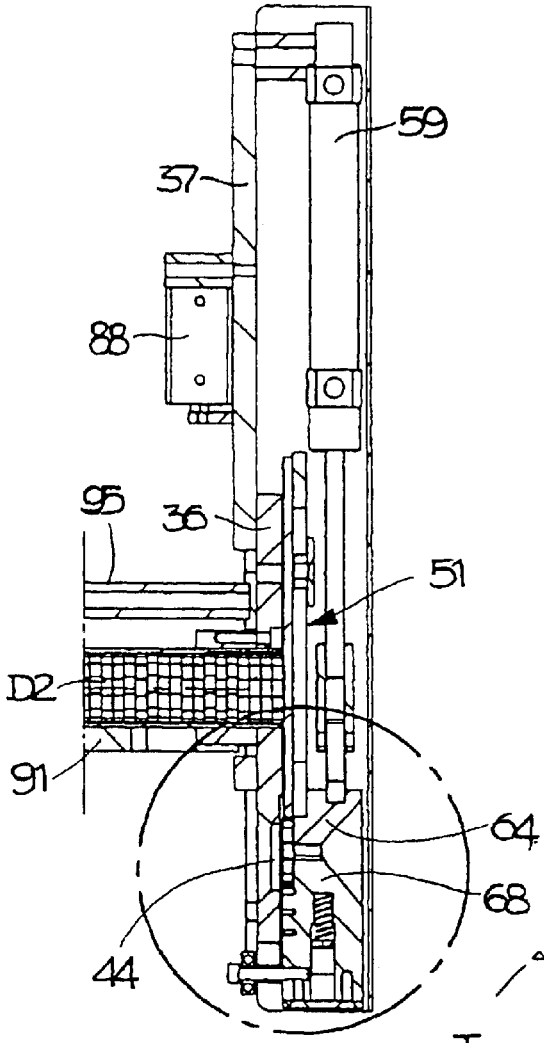
FIG. 8 is a sectional side view, taken along a vertical plane, of the disk feeder arranged behind the mattress and of the disk pick-up and placement means.
Figure 9:
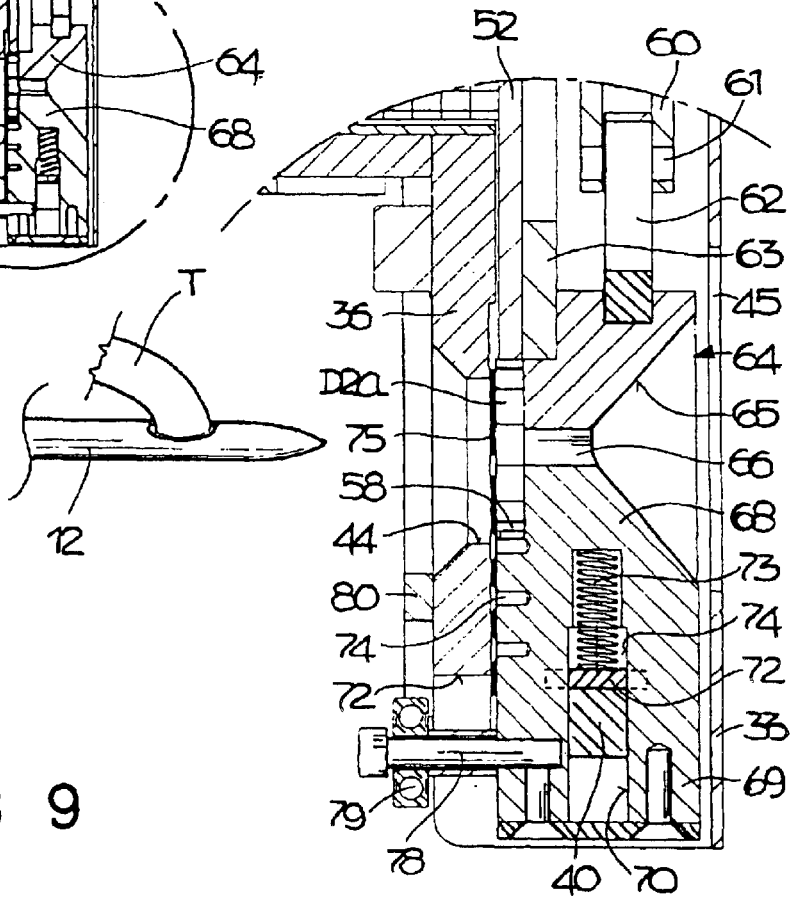
FIG. 9 is an enlarged-scale view of the detail enclosed in the circle in FIG. 8.
Figure 11:
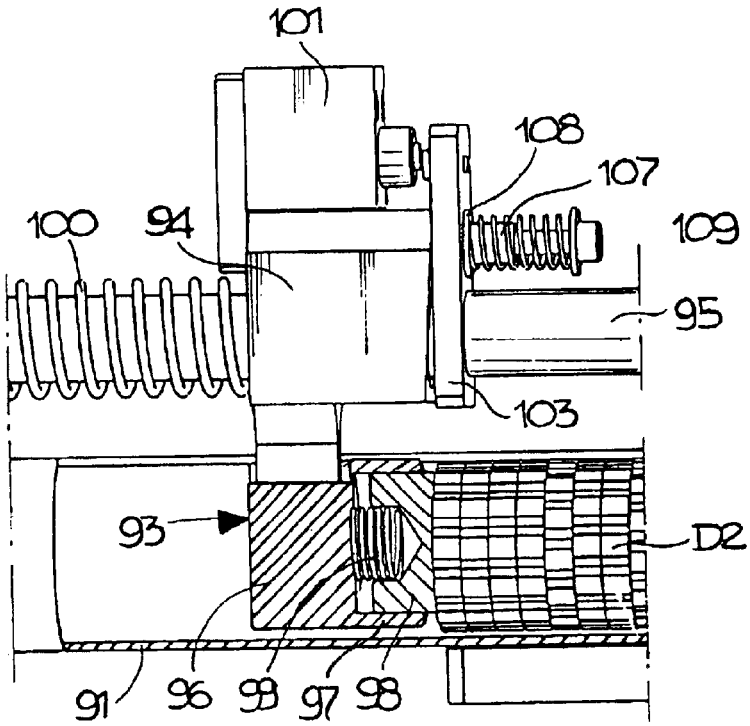
FIGS. 11 and 12 are two partial views of the feeder of FIG. 10 in two different operating positions.
Figure 12:
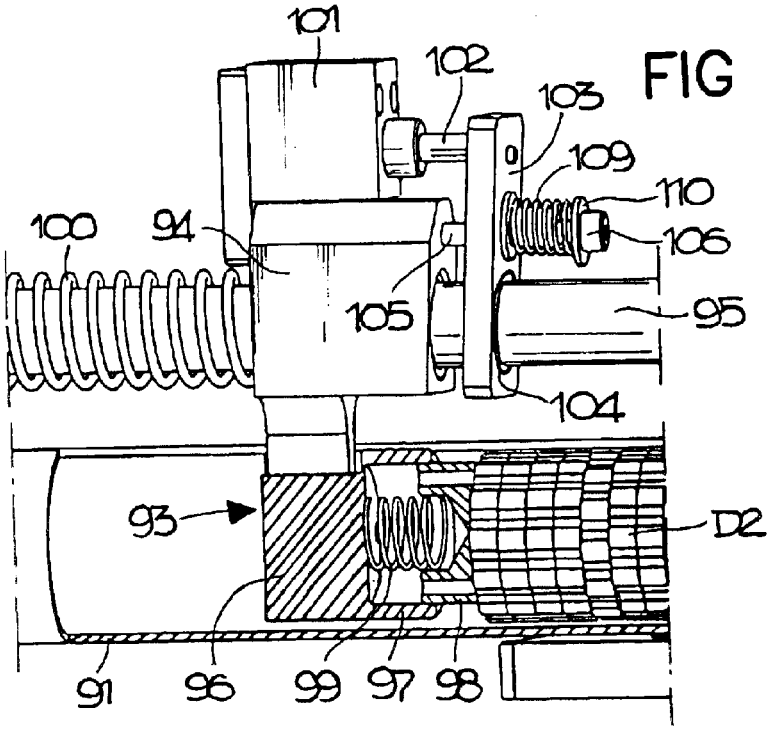
Figure 14:
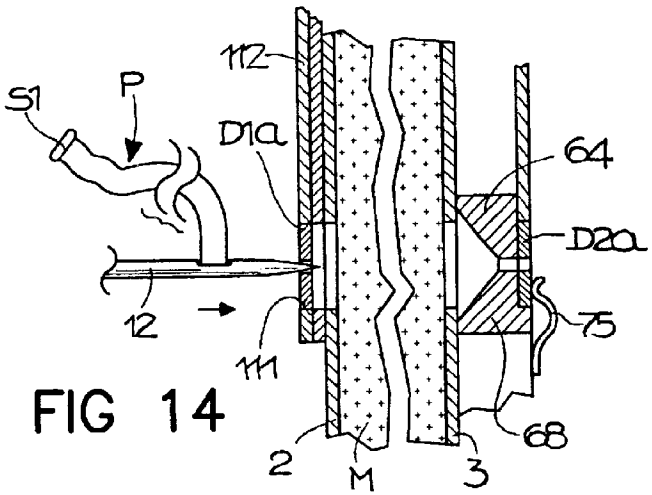
FIGS. 13, 14, 15 and 16 are schematic views of successive operating steps of the apparatus.
Figure 16:
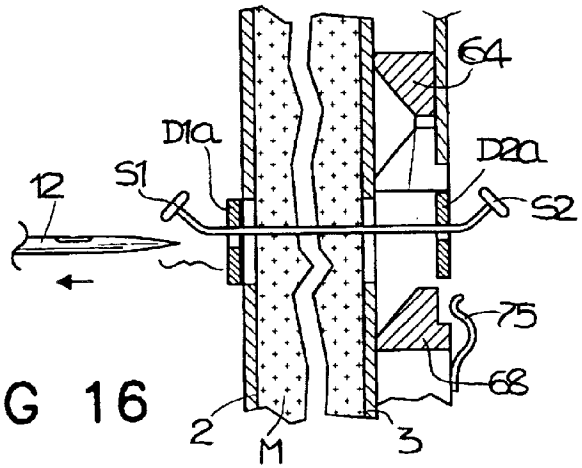

In this manner, the pusher 93, under the thrust applied by the spring 100, compresses the stack in the seat 58 against the plate 52 of the sliding block 51 (FIGS. 8 and 10). Since the spring 99 is far weaker than the spring 100, the piston 98 therefore remains inside the bush 97 (FIG. 11). When the front disk D2*a* is accommodated in the seat 58, and before the sliding block 51 is lowered in order to transfer the front disk in front of the lower opening 44, the actuator 101 is activated and its stem 102, by acting on the lever 103, blocks it on the bar 85 over a first portion of its stroke and, over a second portion of its stroke, moves backward the slider 94 and therefore the pusher 93 so that the thrust applied by the piston to the stack is at that point only the thrust due to the weaker spring 99. Therefore, the compression force of the stack is reduced greatly, facilitating the extraction of the front disk D2*a* by the body 64.

When the extraction of the front disk has been completed, the actuator 101 is deactivated again in order to allow the spring 100 to make the stack advance in order to insert a new disk in the seat 58.

The disclosures in Italian Patent Application No. BO2002A000549 from which this application claims priority are incorporated herein by reference.

What is claimed is:

1. An apparatus for inserting, through a mattress, tuft assemblies constituted by a flexible tension element that has, at opposite ends thereof, retention elements shaped as two bars arranged in a T-shaped configuration adapted to abut, with protective elements interposed, providable as a first disk and a second disk, against the opposite faces of the mattress, the apparatus comprising: a structure for locking the mattress composed of two walls, which are flat and mutually parallel and delimit a space for accommodating the mattress for compression thereof to a thickness that is shallower than a length of the tuft assemblies; a first carriage, which is supported by one of said walls and is provided with a first disk feeder and an insertion device for inserting tuft assemblies through said mattress; a second carriage which is supported by the second one of said walls and is provided with a second disk feeder; actuation means for actuating said first and second carriages along a preset path;

wherein said insertion device comprises: a tuft assembly loader; a needle that is guided at right angles to said mattress and has a tip that is provided with a seat adapted to receive a first one of said two bars of a tuft assembly that is fed by said loader; and needle actuation means for actuating said needle through said mattress between a position in which said tip is upstream of the mattress, in order to receive said first bar in said seat, and a position in which said tip is downstream of the mattress, in order to release said first bar from said seat; first picking means, mounted on said first carriage, for picking up a disk from said first feeder and placing the disk upstream of said mattress and in alignment with said needle; and second picking means, mounted on said second carriage, for picking up a disk from said second feeder and placing the disk downstream of said mattress and in alignment with said needle;

and wherein each one of said first and second disk feeders comprises: a disk magazine supported on a respective one of said first and second carriages and containing disks arranged to form a stack that is perpendicular to said mattress; and pusher means that act on said stack in order to keep a front disk of said disk stack in a pick-up position;

and wherein each one of said picking means comprises a transfer element supported by a respective one of said first and second carriages and is actuated so as to pick up the front disk from said magazine and transfer the disk in alignment with said needle.

2. The apparatus of claim 1, wherein said transfer element comprises: a plate-like element that is fixed on a respective one of said first and second carriages; a first opening that is formed in said plate-like element and is aligned with said needle; a second opening that is formed in said plate-like element and is aligned with said stack to receive said front disk, a guiding channel formed on said plate-like element in alignment with said first and second openings; a sliding block that is slidable in said guiding channel and has a first portion for guiding said sliding block with play in said guiding channel and a second portion for guiding said sliding block without play in said guiding channel, said second portion having a seat for accommodating a front disk, block actuation means for actuating said sliding block between a position for playless guiding in said guiding channel and in which said seat faces said stack in order to receive said front disk, and a position for play guiding of said sliding block in said guiding channel and in which said seat faces said first opening; and a body which is rigidly coupled to said second portion and forms a concavity that has a conical surface connected to said seat through a radial slot engaged by a sector that completes said conical surface and forms a duct aligned with said needle when said seat faces said first opening.

3. The apparatus according to claim 2, further comprising an articulation pivot; said sliding block having slot that is elongated in a direction of said guiding channel and being engaged by said articulation pivot that allows oscillation of said sliding block about said pivot when said seat faces said first opening.

4. The apparatus of claim 3, further comprising a bar and a block to which said sector is rigidly coupled and which is supported so as to oscillate on said bar that is rigidly coupled to said plate-like element below said first opening, said sector being engaged elastically by friction on said bar in order to follow movements of said body caused by oscillations of said sliding block.

5. The apparatus of claim 4, wherein said block actuation means comprise a hydraulic actuator that has a cylinder connected to said plate-like element and a stem that is articulated with play to said body.

6. The apparatus of claim 5, comprising a hydraulic actuator, said sector being actuatable in opposition to said body by way of said hydraulic actuator that is fixed to said plate-like element and acts on said block with an element thereof that forms a centering cam adapted to return said sector into alignment with said slot of said body.

7. The apparatus of claim 6, comprising a roller that is rigidly coupled to said block, said centering cam having a convex profile that is formed by two ramps arranged in a V-like configuration, said convex profile being engaged by said roller.

8. The apparatus of claim 7, comprising an elastic lamina rigidly coupled to said block for retaining in said seat, in front of said first opening, a picked front disk.

9. The apparatus of claim 8, wherein walls of said slot of said body form a guide for insertion of said sector in said slot.

10. The apparatus of claim 9, wherein said disk feeder comprises a disk container that is associated at right angles with said plate-like element and is aligned with said second opening, said container being provided with a longitudinal slot through which said pusher means acts on said stack, said pusher means being constituted by a slider that is slidable on a guide bar that is parallel to said container and is provided with an arm, and by a first spring, said arm engaging in said container through said slot and being actuated against said stack by said first spring that acts on said slider and is arranged on said guide bar.

11. The apparatus of claim 10, further comprising: a coaxial bush associated with said arm inside said container; a second spring; a piston guided in said bush, said piston being actuated by said second spring that is weaker than said first spring that acts on the slider, said slider being provided with a retracting element for retracting and locking the slider so that thrust applied to the stack of disks is determined only by said second spring that acts on said piston.

12. The apparatus of claim 11, wherein said retracting element comprises: an actuator that is fixed to said slider and has a stem that is parallel to said guide bar; a lever that is articulately coupled to said stem and has a hole for passage of said guide bar; a rod that is rigidly coupled to said slider and is driven through said lever between a coupling of said stem and said hole; a third spring that is arranged on said rod to allow said lever to oscillate between a position in which said slider is freely slidable on said guide bar when the stack must advance upon thrust of said first spring and a position for locking on said guide bar and for retracting said slider when the thrust of said first spring must be neutralized in order to allow action with the second spring alone, so as to obtain a controlled thrust on said stack.

* * * * *